US010605100B2

(12) United States Patent
Kittleson et al.

(10) Patent No.: US 10,605,100 B2
(45) Date of Patent: Mar. 31, 2020

(54) CERAMIC MATRIX COMPOSITE (CMC) TURBINE BLADE ASSEMBLY, DOVETAIL SLEEVE, AND METHOD OF MOUNTING CMC TURBINE BLADE

(71) Applicant: GENERAL ELECTRIC COMPANY, Schenectady, NY (US)

(72) Inventors: Jacob John Kittleson, Greenville, SC (US); John McConnell Delvaux, Fountain Inn, SC (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 190 days.

(21) Appl. No.: 15/604,074

(22) Filed: May 24, 2017

(65) Prior Publication Data

US 2018/0340429 A1 Nov. 29, 2018

(51) Int. Cl.
*F01D 5/28* (2006.01)
*F01D 5/30* (2006.01)

(52) U.S. Cl.
CPC ..... *F01D 5/282* (2013.01); *F01D 5/284* (2013.01); *F01D 5/3007* (2013.01); *F01D 5/3084* (2013.01); *F05D 2230/60* (2013.01); *F05D 2300/6033* (2013.01)

(58) Field of Classification Search
CPC ..... F01D 5/282; F01D 5/284; F01D 5/3007; F01D 5/3015; F01D 5/3084; F01D 5/3092; F05D 2230/51; F05D 2230/60; F05D 2230/64; F05D 2230/644; F05D 2260/15; F05D 2260/30; F05D 2300/6033
See application file for complete search history.

(56) References Cited

U.S. PATENT DOCUMENTS 9,157,330 B2 * 10/2015 Garin ..... F01D 5/3084
9,500,083 B2 11/2016 Cairo et al.
9,611,746 B2 * 4/2017 Luczak ..... F01D 5/26

FOREIGN PATENT DOCUMENTS

WO 2014081496 A1 5/2014

* cited by examiner

*Primary Examiner* — Moshe Wilensky
*Assistant Examiner* — Alexander A White
(74) *Attorney, Agent, or Firm* — McNees Wallace & Nurick LLC

(57) ABSTRACT

A ceramic matrix composite (CMC) turbine blade assembly includes a rotor, a CMC turbine blade, and at least one dovetail sleeve. The rotor has a blade slot with at least one slot surface. The slot surface is at a slot angle. The CMC turbine blade is received in the blade slot. The CMC turbine blade includes a dovetail root having at least one root surface. The root surface is at a root angle. The root angle is at least 5 degrees greater than the slot angle. The dovetail sleeve is received in the blade slot of the rotor. The dovetail sleeve has at least one inner surface contacting at least one root surface and at least one outer surface contacting at least one slot surface to radially retain the CMC turbine blade in the blade slot. A dovetail sleeve and a method of mounting a CMC turbine blade are also disclosed.

20 Claims, 4 Drawing Sheets

CERAMIC MATRIX COMPOSITE (CMC) TURBINE BLADE ASSEMBLY, DOVETAIL SLEEVE, AND METHOD OF MOUNTING CMC TURBINE BLADE

FIELD OF THE INVENTION

The present embodiments are directed to ceramic matrix composite (CMC) turbine blade assemblies. More specifically, the present embodiments are directed to dovetail sleeves and CMC turbine blade assemblies including dovetail sleeves.

BACKGROUND OF THE INVENTION

The manufacture of a ceramic matrix composite (CMC) part typically includes laying up pre-impregnated composite fibers having a matrix material already present (prepreg) to form the geometry of the part (pre-form), autoclaving and burning out the pre-form, infiltrating the burned-out pre-form with the melting matrix material, and any machining or further treatments of the pre-form. Infiltrating the pre-form may include depositing the ceramic matrix out of a gas mixture, pyrolyzing a pre-ceramic polymer, chemically reacting elements, sintering, generally in the temperature range of 925 to 1650° C. (1700 to 3000° F.), or electrophoretically depositing a ceramic powder. With respect to turbine airfoils, the CMC may be located over a metal spar to form only the outer surface of the airfoil.

Examples of CMC materials include, but are not limited to, carbon-fiber-reinforced carbon (C/C), carbon-fiber-reinforced silicon carbide (C/SiC), silicon-carbide-fiber-reinforced silicon carbide (SiC/SiC), alumina-fiber-reinforced alumina ($Al_2O_3/Al_2O_3$), or combinations thereof. The CMC may have increased elongation, fracture toughness, thermal shock, dynamic load capability, and anisotropic properties as compared to a monolithic ceramic structure.

Conventional CMC blades typically only include one dovetail, which has two opposing pressure faces that contact the rotor tangs. As a result, the area that is required on each pressure face is high, and the fillet from the airfoil that transitions to these pressure faces may be large. If the fillet and pressure faces are large enough, the reduction in total rotor circumferential tang length may be reduced to a point at which the rotor is compromised. Additionally, it would be preferable for the fillet and neck region of the composite blade to be larger in order to maintain safe operation and reduced interlaminar tension generally seen in the neck region. CMC blades are highly orthotropic, and bending from the dovetail pressure contact faces induces a moment that attempts to pry the plies apart in the neck region perpendicular to the radial loading direction.

A lower flank angle on the CMC dovetail increases fillet and interlaminar tension (ILT) stresses and increases wear concerns due to a higher normal force, but there is a risk of lock up for higher flank angles.

BRIEF DESCRIPTION OF THE INVENTION

In an embodiment, a ceramic matrix composite (CMC) turbine blade assembly includes a rotor, a CMC turbine blade, and at least one dovetail sleeve. The rotor has a blade slot with at least one slot surface. The slot surface is at a slot angle. The CMC turbine blade is received in the blade slot. The CMC turbine blade includes a dovetail root having at least one root surface. The root surface is at a root angle. The root angle is at least 5 degrees greater than the slot angle.

The dovetail sleeve is received in the blade slot of the rotor. The dovetail sleeve has at least one inner surface contacting at least one root surface and at least one outer surface contacting at least one slot surface to radially retain the CMC turbine blade in the blade slot.

In another embodiment, a dovetail sleeve includes a first contour on a first side of the dovetail sleeve and a second contour on a second side of the dovetail sleeve opposite the first side. The first contour includes a pair of outer surfaces at an outer angle. The second contour includes a pair of inner surfaces at an inner angle at least 5 degrees greater than the outer angle. The dovetail sleeve is sized to be received in a blade slot of a rotor such that the pair of inner surfaces contact a pair of root surfaces of a dovetail root of a CMC turbine blade and the pair of outer surfaces contact a pair of slot surfaces of the blade slot to radially retain the CMC turbine blade in the blade slot.

In yet another embodiment, a method of mounting a ceramic matrix composite (CMC) turbine blade includes inserting at least one dovetail sleeve into a blade slot of a rotor and inserting a dovetail root of the CMC turbine blade into a dovetail slot of a dovetail sleeve. The blade slot has at least one slot surface at a slot angle. The dovetail root has at least one root surface at a root angle. The root angle is at least 5 degrees greater than the slot angle. The dovetail sleeve has at least one inner surface contacting the root surface and at least one outer surface contacting the slot surface to radially retain the CMC turbine blade in the blade slot.

Other features and advantages of the present invention will be apparent from the following more detailed description, taken in conjunction with the accompanying drawings which illustrate, by way of example, the principles of the invention.

BRIEF DESCRIPTION OF THE DRAWINGS

Wherever possible, the same reference numbers will be used throughout the drawings to represent the same parts.

DETAILED DESCRIPTION OF THE INVENTION

Provided is a ceramic matrix composite (CMC) turbine blade assembly, a dovetail sleeve, and a method of mounting a CMC turbine blade.

Embodiments of the present disclosure, for example, in comparison to concepts failing to include one or more of the features disclosed herein, decrease fillet stresses, decrease interlaminar stresses, decrease interlaminar tension (ILT) in the CMC turbine blade, reduce wear on the rotor, reduce the maximum dovetail thickness, reduce normal forces, reduce material costs, promote locking during operation, reduce the risk of lockup during operation, increase rotor tang next section thickness, or combinations thereof.

Figure 1:
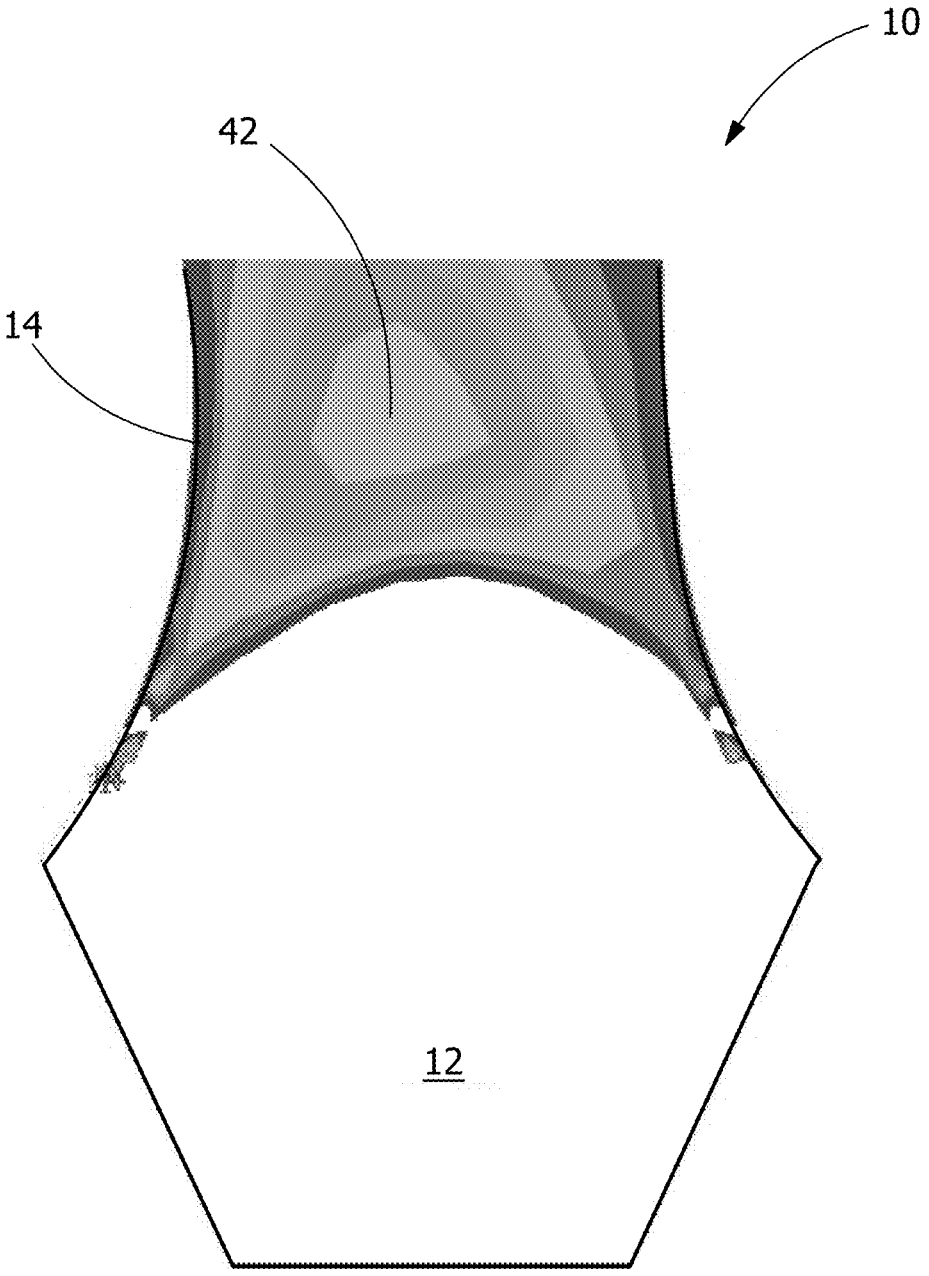
FIG. 1 is a cross sectional view of a portion of a prior art ceramic matrix composite (CMC) turbine blade.

Referring to FIG. 1, the CMC turbine blade 10 includes a dovetail root 12 and a narrowed neck region 14. The shading in the narrowed neck region 14 represents the amount of interlaminar tension (ILT) in the CMC turbine blade 10, with an area of maximum ILT 42 shown in the middle of the narrowed neck region 14. Only a lower portion of the airfoil of the CMC turbine blade 10 is shown extending from the narrowed neck region 14 in FIG. 1.

Figure 2:
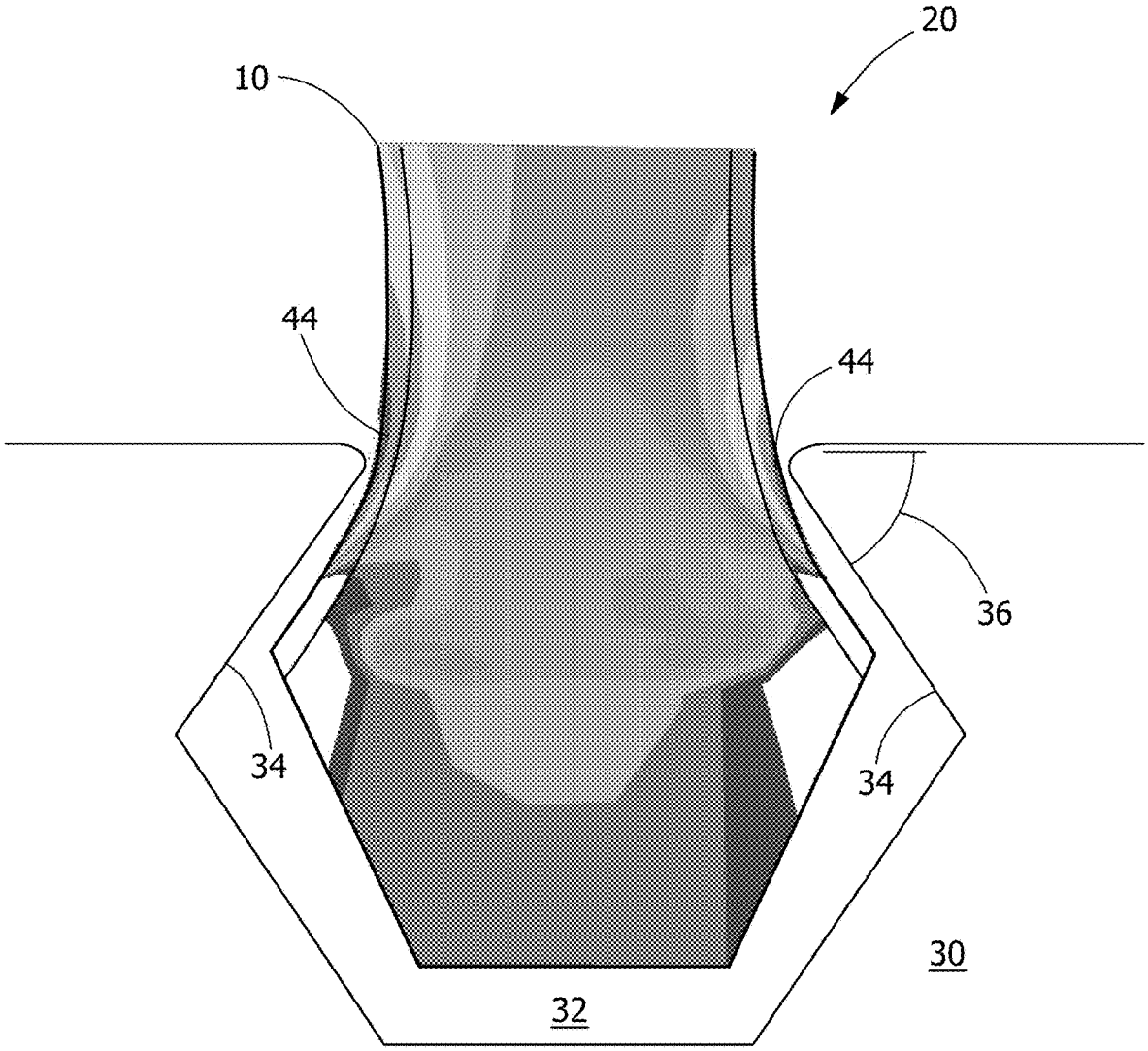
FIG. 2 is a cross sectional view of a portion of a prior art CMC turbine blade assembly.

Referring to FIG. 2, the CMC turbine blade assembly 20 includes a CMC turbine blade 10 received in the blade slot 32 of a rotor 30. The blade slot 32 has a slot surface 34 that contacts the CMC turbine blade 10 at a slot angle 36 of about 55 degrees. The shading in FIG. 1 represents the stress in the CMC turbine blade 10 with radial fillet stress 44 from contact between the rotor 30 and the CMC turbine blade 10 causing a maximum stress in the CMC turbine blade 10.

Figure 3:
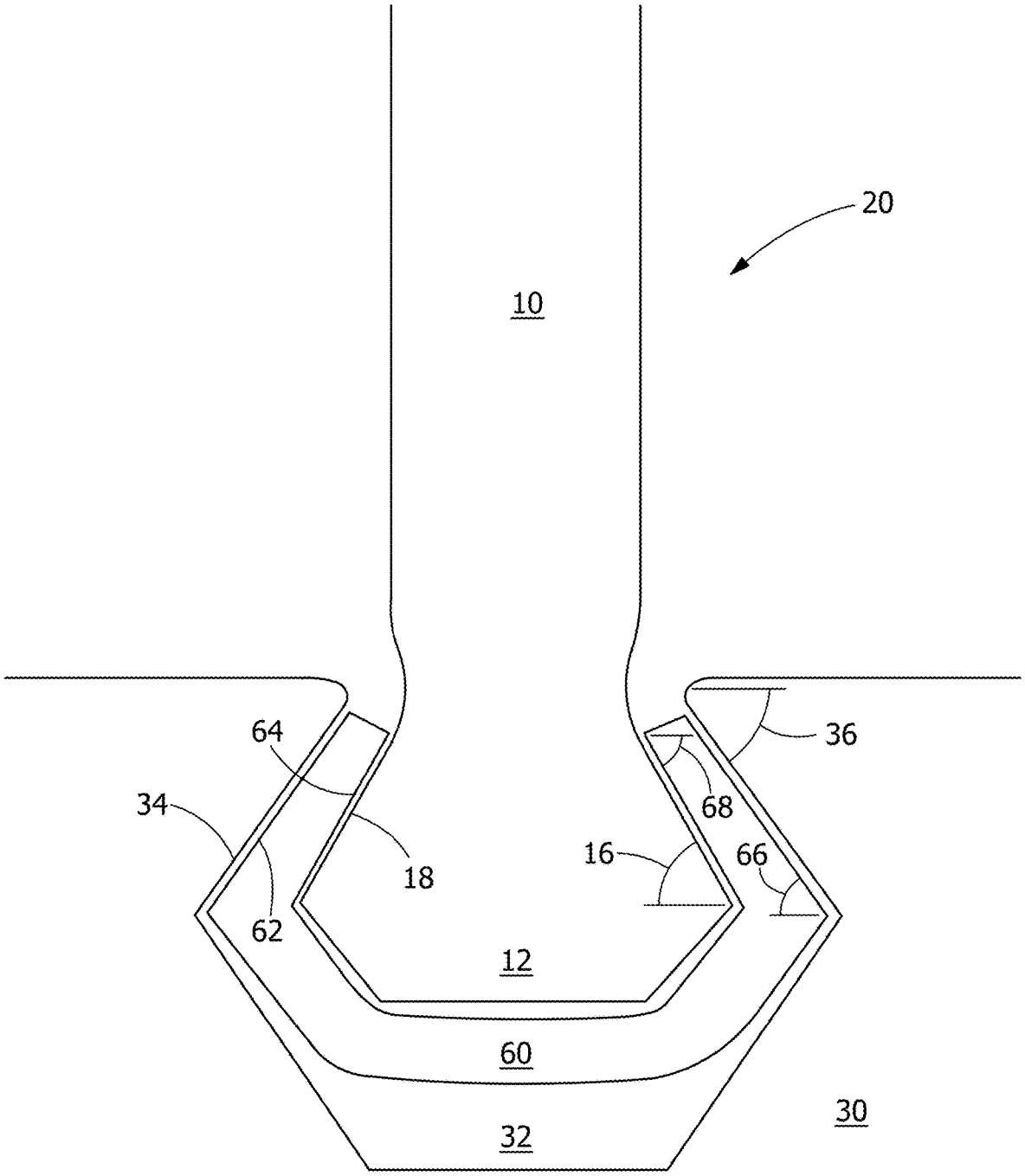
FIG. 3 is a cross sectional view of a CMC turbine blade assembly in an embodiment of the present invention.

FIG. 3 shows a CMC turbine blade assembly 20 including a dovetail sleeve 60 located between the dovetail root 12 of the CMC turbine blade 10 and the rotor 30. The dovetail sleeve 60 prevents direct contact between the CMC turbine blade 10 and the rotor 30. The dovetail sleeve 60 includes a pair of outer surfaces 62 contacting the slot surfaces 34 of the blade slot 32 and a pair of inner surfaces 64 contacting the root surfaces 18 of the dovetail root 12. Only a lower portion of the airfoil of the CMC turbine blade 10 is shown extending from the dovetail root 12 in FIG. 3.

The dovetail sleeve 60 permits the angle of the contact interface, and thus the direction of the contact stress, of the rotor 30 to be at a different angle than the contact interface of the dovetail root 12 of the CMC turbine blade 10. The outer surface 62 of the dovetail sleeve 60 is at an outer angle 66 substantially equal to the slot angle 36 of the blade slot 32 such that the outer surface 62 and the slot surface 34 are substantially complementary. The inner surface 64 of the dovetail sleeve 60 is at an inner angle 68 substantially equal to the root angle 16 of the dovetail root 12 such that the inner surface 64 and the root surface 18 are substantially complementary. The dovetail sleeve 60 tapers toward the upper end of the dovetail sleeve 60 (toward the narrowed neck region 14 of the CMC turbine blade 10) and acts as a wedge, because the root angle 16 is about 5 degrees or more greater than the slot angle 36.

The root angle 16, the slot angle 36, the outer angle 66, and the inner angle 68 are defined with respect to a plane parallel to the axis of the dovetail root 12 of the CMC turbine blade 10 and perpendicular or normal to a radial vector from the engine axis, as shown in FIG. 3. It should be noted that the dovetail root 12 may be skewed by up to about 20 degrees relative to the rotor/engine centerline axis. In some embodiments, the skewing is about 15 degrees or less.

Figure 4:
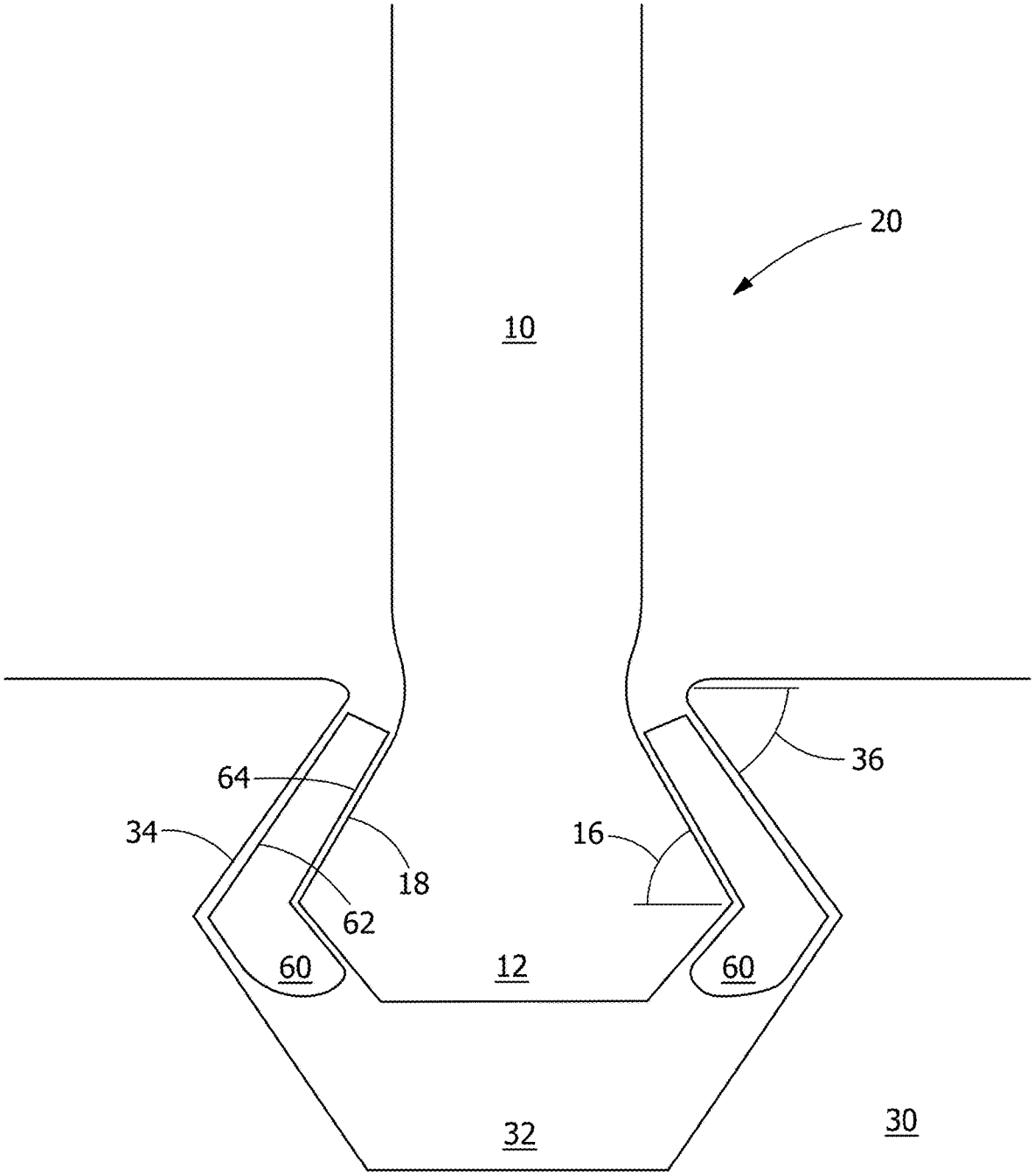
FIG. 4 is a cross sectional view of a CMC turbine blade assembly in another embodiment of the present invention.

Instead of a single dovetail sleeve 60 extending around to both root surfaces 18 of the dovetail root 12, a pair of dovetail sleeves 60 may alternatively be used, as shown in FIG. 4. The CMC turbine blade assembly 20 includes a pair of dovetail sleeves 60 located between the dovetail root 12 of the CMC turbine blade 10 and the rotor 30. The dovetail sleeves 60 prevent direct contact between the CMC turbine blade 10 and the rotor 30. Each dovetail sleeve 60 includes an outer surface 62 contacting one of the slot surfaces 34 of the blade slot 32 and an inner surface 64 contacting one of the root surfaces 18 of the rotor 30.

Each of the pair of dovetail sleeves 60 preferably extends past the widest point of the dovetail root 12, as shown in FIG. 4, to aid in the positioning of the dovetail sleeves 60 and the dovetail root 12 with respect to the blade slot 32, but the dovetail sleeves 60 need not extend to the bottom of the dovetail root 12. The pair of dovetail sleeves 60 include significantly less material than a single dovetail sleeve 60 that extends around to both sides of the dovetail root 12. The pair of dovetail sleeves 60 may be interchangeable or substantially identical in shape, further reducing manufacturing costs. Alternatively, the dovetail sleeve 60 may include more than two fitted pieces.

In some embodiments, the CMC turbine blade 10 and dovetail sleeve 60 address both packaging-related and wear-related issues. The separate dovetail sleeve 60 partially defines a portion of the dovetail root 12 of the CMC turbine blade 10, which reduces the maximum thickness of the dovetail root 12 and also provides wear protection for the rotor 30. The dovetail sleeve 60 permits assembly of a CMC turbine blade 10 with a greater root angle 16 in a rotor 30 with a conventional blade slot 32, such as a blade slot 32 having a slot angle 36 of about 55 degrees.

The dovetail sleeve 60 is preferably metallic. In some embodiments, the dovetail sleeve 60 is a nickel-based alloy. In some embodiments, the nickel-based alloy is any high-temperature-suitable nickel-based superalloy. In some embodiment, the nickel-based alloy is Haynes 282, Inconel 625, Inconel 738, or Rene 108.

As used herein, "Haynes 282" refers to a nickel-based alloy including a composition, by weight, of between about 18.5% and about 20.5% chromium (Cr), between about 9% and about 11% cobalt (Co), between about 8% and about 9% molybdenum (Mo), between about 1.9% and about 2.3% titanium (Ti), between about 1.38% and about 1.65% aluminum (Al), up to about 1.5% iron (Fe), up to about 0.3% manganese (Mn), up to about 0.15% silicon (Si), up to about 0.1% copper (Cu), between about 0.04% and about 0.08% carbon (C), up to about 0.02% zirconium (Zr), up to about 0.015% phosphorus (P), up to about 0.015% sulfur (S), between about 0.003% and about 0.01% boron (B), incidental impurities, and a balance of nickel (Ni).

As used herein, "Inconel 625" refers to a nickel-based alloy including a composition, by weight, of between about 20% and about 23% Cr, between about 8% and about 10% Mo, up to about 5% iron (Fe), between about 3.2% and about 4.2% niobium (Nb) plus tantalum (Ta), up to about 1% Co, up to about 0.5% Mn, up to about 0.5% Si, up to about 0.4% Al, up to about 0.4% Ti, up to about 0.1% carbon (C), incidental impurities, and a balance (at least 58%) of Ni.

As used herein, "Inconel 738" refers to a nickel-based alloy including a composition, by weight, of between about 15.7% and about 16.3% Cr, about 8.0% to about 9.0% Co, between about 3.2% and about 3.7% Ti, between about 3.2% and about 3.7% Al, between about 2.4% and about 2.8% tungsten (W), between about 1.5% and about 2.0% Ta, between about 1.5% and about 2.0% Mo, between about 0.6% and about 1.1% Nb, up to about 0.5% Fe, up to about 0.3% Si, up to about 0.2% Mn, between about 0.15% and about 0.20% C, between about 0.05% and about 0.15% Zr, up to about 0.015% S, between about 0.005% and about 0.015% B, incidental impurities, and a balance of Ni.

As used herein, "Rene 108" refers to a nickel-based alloy including a composition, by weight, of between about 9% and about 10% Co, between about 9.3% and about 9.7% W, between about 8.0% and about 8.7% Cr, between about 5.25% and about 5.75% Al, between about 2.8% and about 3.3% Ta, between about 1.3% and about 1.7% Hf, up to about 0.9% Ti (for example, between about 0.6% and about 0.9% Ti), up to about 0.6% Mo (for example, between about 0.4% and about 0.6% Mo), up to about 0.2% Fe, up to about 0.12% Si, up to about 0.1% Mn, up to about 0.1% Cu, up to about 0.1% C (for example, between about 0.07% and about 0.1% C), up to about 0.1% Nb, up to about 0.02% Zr (for example, between about 0.005% and about 0.02% Zr), up to about 0.02% B (for example, between about 0.01% and about 0.02% B), up to about 0.01% phosphorus (P), up to about 0.004% S, incidental impurities, and a balance of Ni.

In some embodiments, a coating is applied to one or more of the wear surfaces between the rotor 30 and the dovetail sleeve 60 or between the dovetail sleeve 60 and the CMC turbine blade 10. The coating may include cobalt, titanium, graphite or another carbon-containing composition, or combinations thereof.

In some embodiments, the dovetail sleeve 60 is formed such that the stiffness of the dovetail sleeve 60 changes perpendicular to the pressure face of the CMC turbine blade 10 along the axial dovetail loading path. In some embodiments, the stiffness of the dovetail sleeve 60 is lowest at or near the middle of the dovetail sleeve 60 and increases toward the ends of the dovetail sleeve 60 corresponding to the leading edge and trailing edge of the CMC turbine blade 10 along the pressure face. Changing the local stiffness along the dovetail sleeve 60 permits a more constant predetermined loading of the airfoil during transient and normal operations. In some embodiments, the changing stiffness is achieved by casting the dovetail sleeve 60 in non-uniform ribs, by structural modification in the otherwise solid dovetail sleeve 60, or by an additive process.

The difference between the root angle 16 and the slot angle 36 may be about 5 degrees or greater, alternatively about 10 degrees or greater, alternatively in the range of about 5 degrees to about 10 degrees, alternatively in the range of about 5 degrees to about 15 degrees, alternatively in the range of about 10 degrees to about 15 degrees, alternatively about 3 degrees or greater, alternatively in the range of about 3 degrees to about 5 degrees, alternatively in the range of about 4 degrees to about 6 degrees, alternatively in the range of about 5 degrees to about 7 degrees, or any value, range, or sub-range therebetween.

The slot angle 36 may be about 55 degrees, alternatively about 55 degrees or less, alternatively in the range of about 50 degrees to about 55 degrees, alternatively about 60 degrees or less, alternatively in the range of about 50 degrees to about 60 degrees, alternatively in the range of about 54 degrees to about 56 degrees, alternatively in the range of about 53 degrees to about 55 degrees, or any value, range, or sub-range therebetween.

The root angle 16 may be about 60 degrees or greater, alternatively about 65 degrees or greater, alternatively in the range of about 60 degrees to about 65 degrees, alternatively in the range of about 60 degrees to about 70 degrees, alternatively in the range of about 65 degrees to about 70 degrees, alternatively in the range of about 60 degrees to about 62 degrees, alternatively in the range of about 64 degrees to about 66 degrees, or any value, range, or sub-range therebetween.

The difference between the inner angle 68 and the outer angle 66 may be about 5 degrees or greater, alternatively about 10 degrees or greater, alternatively in the range of about 5 degrees to about 10 degrees, alternatively in the range of about 5 degrees to about 15 degrees, alternatively in the range of about 10 degrees to about 15 degrees, alternatively about 3 degrees or greater, alternatively in the range of about 3 degrees to about 5 degrees, alternatively in the range of about 4 degrees to about 6 degrees, alternatively in the range of about 5 degrees to about 7 degrees, or any value, range, or sub-range therebetween.

The outer angle 66 may be about 55 degrees, alternatively about 55 degrees or less, alternatively in the range of about 50 degrees to about 55 degrees, alternatively about 60 degrees or less, alternatively in the range of about 50 degrees to about 60 degrees, alternatively in the range of about 54 degrees to about 56 degrees, alternatively in the range of about 53 degrees to about 55 degrees, or any value, range, or sub-range therebetween.

The inner angle 68 may be about 60 degrees or greater, alternatively about 65 degrees or greater, alternatively in the range of about 60 degrees to about 65 degrees, alternatively in the range of about 60 degrees to about 70 degrees, alternatively in the range of about 65 degrees to about 70 degrees, alternatively in the range of about 60 degrees to about 62 degrees, alternatively in the range of about 64 degrees to about 66 degrees, or any value, range, or sub-range therebetween.

Although only a single dovetail section is shown, the dovetail section may be a single dovetail section or a double dovetail section. In some embodiments, the dovetail sleeve 60 is contained within the single or double dovetail section and continuously surrounds the convex and concave pressure faces of the dovetail root 12. In some embodiments, the root angle 16 of the dovetail root 12 to dovetail sleeve 60 contact is substantially greater than about 60 degrees to promote locking during operation, while the external surface of the sleeve is about 55 degrees or less to reduce the chance of lockup. Increasing the root angle 16 above 55 degrees is expected to reduce stress by about 5% to about 10%, thereby reducing material costs.

Although only a dovetail root 12 is shown, the root of the CMC turbine blade 10 may alternatively be a fir tree root.

Although the rotor 30 is shown as a single piece, the rotor 30 may alternatively include a rotor segment contacting the dovetail sleeve 60 that is an adapter segment fitted into the rotor wheel. In some embodiments, the rotor segment accommodates the thicker narrowed neck region 14 of the CMC turbine blade 10 relative to a comparable metal turbine blade. In some embodiments, a stronger high temperature adapter segment may also be used.

While the invention has been described with reference to one or more embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims. In addition, all numerical values identified in the detailed description shall be interpreted as though the precise and approximate values are both expressly identified.

What is claimed is:

1. A ceramic matrix composite (CMC) turbine blade assembly comprising:

a rotor having a blade slot with at least one slot surface, the at least one slot surface being at a slot angle;

a CMC turbine blade received in the blade slot, the CMC turbine blade comprising a dovetail root having at least one root surface, the at least one root surface being at a root angle, the root angle being at least 5 degrees greater than the slot angle; and at least one dovetail sleeve received in the blade slot of the rotor, the at least one dovetail sleeve having at least one inner surface contacting the at least one root surface and at least one outer surface contacting the at least one slot surface to radially retain the CMC turbine blade in the blade slot;

wherein a local stiffness of the at least one dovetail sleeve increases along a length of the at least one dovetail sleeve from a middle of the at least one dovetail sleeve toward a first end of the at least one dovetail sleeve and a second end of the at least one dovetail sleeve opposite the first end.

2. The CMC turbine blade assembly of claim 1, wherein the at least one inner surface of the at least one dovetail sleeve is at an inner angle complementary to the root angle.

3. The CMC turbine blade assembly of claim 1, wherein the at least one outer surface of the at least one dovetail sleeve is at an outer angle complementary to the slot angle.

4. The CMC turbine blade assembly of claim 1, wherein the slot angle is about 55 degrees or less.

5. The CMC turbine blade assembly of claim 1, wherein the root angle is about 60 degrees or more.

6. The CMC turbine blade assembly of claim 1, wherein the at least one dovetail sleeve is metallic.

7. The CMC turbine blade assembly of claim 1, wherein the at least one dovetail sleeve is a pair of dovetail sleeves, each of the pair of dovetail sleeves contacting one of a pair of the at least one root surface and one of a pair of the at least one slot surface.

8. The CMC turbine blade assembly of claim 1, wherein the CMC turbine blade does not directly contact the rotor in the CMC turbine blade assembly.

9. A dovetail sleeve comprising:

a first contour on a first side of the dovetail sleeve, the first contour having a pair of outer surfaces at an outer angle; and a second contour on a second side of the dovetail sleeve opposite the first side, the second contour having a pair of inner surfaces at an inner angle at least 5 degrees greater than the outer angle;

wherein the dovetail sleeve is sized to be received in a blade slot of a rotor such that the pair of inner surfaces contact a pair of root surfaces of a dovetail root of a ceramic matrix composite (CMC) turbine blade and the pair of outer surfaces contact a pair of slot surfaces of the blade slot to radially retain the CMC turbine blade in the blade slot; and wherein a local stiffness of the dovetail sleeve increases along a length of the dovetail sleeve from a middle of the dovetail sleeve toward a first end of the dovetail sleeve and a second end of the dovetail sleeve opposite the first end.

10. The dovetail sleeve of claim 9, wherein the outer angle is about 55 degrees or less.

11. The dovetail sleeve of claim 9, wherein the inner angle is about 60 degrees or more.

12. The dovetail sleeve of claim 9, wherein the dovetail sleeve is metallic.

13. A method of mounting a ceramic matrix composite (CMC) turbine blade, the method comprising:

inserting at least one dovetail sleeve into a blade slot of a rotor, the blade slot having at least one slot surface at a slot angle; and inserting a dovetail root of the CMC turbine blade into a dovetail slot of at least one dovetail sleeve, the dovetail root having at least one root surface at a root angle, the root angle being at least 5 degrees greater than the slot angle;

wherein the at least one dovetail sleeve has at least one inner surface contacting the at least one root surface and at least one outer surface contacting the at least one slot surface to radially retain the CMC turbine blade in the blade slot; and wherein a local stiffness of the at least one dovetail sleeve increases along a length of the at least one dovetail sleeve from a middle of the at least one dovetail sleeve toward a first end of the at least one dovetail sleeve and a second end of the at least one dovetail sleeve opposite the first end.

14. The method of claim 13, wherein the at least one inner surface of the at least one dovetail sleeve is at an inner angle complementary to the root angle and the at least one outer surface of the at least one dovetail sleeve is at an outer angle complementary to the slot angle.

15. The method of claim 13, wherein the slot angle is about 55 degrees or less.

16. The method of claim 13, wherein the root angle is about 60 degrees or more.

17. The method of claim 13, wherein the at least one dovetail sleeve is metallic.

18. The method of claim 13, wherein the at least one dovetail sleeve is a pair of dovetail sleeves, each of the pair of dovetail sleeves contacting one of a pair of the at least one root surface and one of a pair of the at least one slot surface.

19. The method of claim 13, wherein the CMC blade does not directly contact the rotor in the CMC turbine blade assembly.

20. The method of claim 13 further comprising casting the at least one dovetail sleeve in non-uniform ribs to achieve the local stiffness.

* * * * *